US006463848B1

(12) United States Patent
Haberstroh et al.

(10) Patent No.: US 6,463,848 B1
(45) Date of Patent: Oct. 15, 2002

(54) STRAPPER WITH IMPROVED WINDING AND CUTTING ASSEMBLY

(75) Inventors: James A. Haberstroh, Vernon Hills; Robert J. Kobiella, Rolling Meadows; Timothy B. Pearson, Antioch; Mark B. Renz, Arlington Heights, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/566,512

(22) Filed: May 8, 2000

(51) Int. Cl.[7] ..... B65B 13/22
(52) U.S. Cl. ..... 100/32; 53/589; 100/26
(58) Field of Search ..... 100/8, 26, 29, 100/32; 53/589

(56) References Cited

U.S. PATENT DOCUMENTS 4,605,456 A * 8/1986 Annis, Jr. ..... 100/29
5,078,058 A * 1/1992 Schwede et al. ..... 100/32
6,003,438 A * 12/1999 Schwede ..... 100/32

* cited by examiner

*Primary Examiner*—Stephen F. Gerrity

(74) *Attorney, Agent, or Firm*—Donald J. Breh; Mark W. Croll; Lisa M. Soltis

(57) ABSTRACT

A strapping machine for positioning a strap material around an associated load and tensioning the strap material around the load includes a frame for supporting the load, a chute positioned on the frame for receiving the strap material and orienting the strap material around the load, a strap supply and a strapping head for extracting the strap from the supply, feeding the strap through the chute around the load, passing the strap from the chute around the load, retracting and tensioning the strap. The strapping head includes feed rollers and retraction rollers for feeding and retracting the strap and a winder for tensioning the strap around the load. The winder is positioned between the feed and retraction rollers and the strap supply. The winder includes a rotating head portion having a stationary element and a pivotal element. The stationary and pivotal elements each define an outer surface around which the strap material is wound and a slot therebetween for receiving the strap material. The stationary and pivotal elements each further define a gripping portion at about respective ends opposingly facing one another. The pivotal element is pivotal between an open position in which the gripping portions are spaced from one another and a closed position in which the gripping portions cooperate with one another to engage and secure the strap material therebetween. The winder rotates from a home position in which the winder is in the open position and an other than home position in which the winder is in the closed position to exert a tension in the strap.

11 Claims, 4 Drawing Sheets

STRAPPER WITH IMPROVED WINDING AND CUTTING ASSEMBLY

FIELD OF THE INVENTION

This invention pertains to strapping machines. More particularly, the present invention pertains to an improved drive arrangement for a strapping machine including a rewind member and cutting arrangement.

BACKGROUND OF THE INVENTION

Strapping machines are in widespread use for applying a strap, such as a plastic strap, in a tensioned loop around a load. A typical strapping machine includes a strap chute for guiding the strap around the load, a strapping head through which the leading end of the strap is fed, and a strap dispenser to dispense a desired length of strap from a coil of strap material.

The strapping head carries out a number of functions. It advances the strap along the chute around the load until the leading end returns to the strapping head and retracts or rewinds the strap from the chute to produce tension in the strap around the load. The strapping head typically includes an assembly for securing the strap in the tensioned loop around the load such as by welding the strap to itself at its overlapping portions.

A typical strapping head includes a pair of advancing rollers for advancing the strap through the strapping head and a pair of retraction rollers for retracting the strap to, for example, take-up the strap. The head also includes a winder or tensioner that rewinds or takes up the strap after it is positioned around the load so as to apply a tension in the strap. In one known configuration, the winder includes a split-type rotating element that has a channel or slot formed therethrough to essentially define split halves of the winder. The split halves are fixed relative to one another and the strap traverses through the slot between the halves. Upon an appropriate signal, the winder is actuated and rotates to tension the strap.

In a typical winder arrangement, the strap is not in tension until it passes over itself around the winder, thus creating sufficient friction to prevent the strap from slipping through the winder slot. It has been observed that often, the winder must rotate in excess of 360 degrees, and with some types of readily compressible loads, it must rotate more than 720 degrees to provide sufficient friction to begin tensioning and to provide the appropriate tension on the strap.

In known strapping heads, the winder is positioned intermediate the feed and retraction rollers. An arrangement such as this disclosed in U.S. Pat. No. 4,605,456 which patent is assigned to the assignee of the present application and is hereby incorporated by reference. Although the strapping machine disclosed in this patent functions well, it does have certain drawbacks. For example, it has been found that in known strapping machines, the strap may not automatically refeed after faulted strap is ejected following a jam in the machine or after significant rewinding following load compression. It has also been found that in known strapping head configurations, adjustments may also be necessary in order to accommodate varying gauges of the strap material. It has further been found that the rewinding length may be limited due to structural constraints of the strapping head, winder and drive arrangement.

Accordingly, there exists a need for a strapping machine having a winder that commences effective tensioning of the strap without the strap having to wind over itself. Desirably, such a winder is effective over a range of strap gauges and can be used with highly compressible loads. More desirably, such a winder permits positioning the winder within the strapping head so as to take advantage of automatically refeeding the strap through the strapping heading following faulted strap ejection.

SUMMARY OF THE INVENTION

A strapping machine for positioning a strap material around an associated load and tensioning the strap material around the load includes a frame for supporting the load, a chute positioned on the frame for receiving the strap material and orienting the strap material around the load, a strap supply and a strapping head for extracting the strap from the supply, feeding the strap through the chute around the load, passing the strap from the chute around the load, retracting and tensioning the strap.

The strapping head includes feed rollers and retraction rollers for feeding and retracting the strap and a winder for tensioning the strap around the load. Preferably, the winder includes a rotating head portion having a stationary element and a pivotal element, each defining an outer surface around which the strap material is wound. The stationary and pivotal elements define a slot therebetween for receiving the strap material. Each element defines a gripping portion at about a respective end that is opposingly facing the other of the gripping portions.

The pivotal element is pivotal between an open position in which the gripping portions are spaced from one another and a closed position in which the gripping portions cooperate with one another to engage and secure the strap material therebetween. The winder rotates from a home position in which the winder is in the open position and an other than home position in which the winder is in the closed position to exert a tension in the strap. In a most preferred embodiment, the winder is positioned between the feed and retraction rollers and the strap supply.

In a preferred winder, the pivotal element is biasedly mounted to the head portion into the closed position and includes a projection extending from the pivotal element for maintaining the pivotal element in the open position when the winder is in the home position.

The winder includes a drive assembly for rotating the winder head portion. Preferably, the winder includes a winder biasing element, such as a clock-type spring for returning the winder to the home position.

The strapping machine can include one or more intermediate stop plates positioned between the winder head portion and the frame. The intermediate stop plates permit greater than 360 degree rotation of the winder relative to the strapping machine.

A preferred embodiment of the strapping machine includes a cam having a feed surface, a retraction surface and an intermediate surface and a linkage assembly for actuating the feed rollers, the retraction rollers and the winder. The preferred linkage includes a single cam-contacting linkage arm configured to bear against the cam.

The linkage is configured to move the feed rollers into engagement with the strap material and to move the retraction rollers out of engagement with the strap material when the cam-contacting linkage arm bears against the feed surface. The linkage is further configured to move the retraction rollers into engagement with the strap material and to move the feed rollers out of engagement with the strap material when the cam-contacting linkage arm bears against the retraction surface. The linkage further moves the feed rollers and the retraction rollers out of engagement with the strap material when the cam-contacting linkage arm bears against the intermediate surface.

To this end, the linkage assembly includes a second linkage arm configured to bear against the single, cam-contacting linkage arm. The cam-contacting linkage arm is configured to move the feed rollers into and out of engagement with the strap material and the second linkage arm is configured to move the retraction rollers into and out of engagement with the strap material.

A most preferred embodiment of the strapping machine includes a cutting assembly positioned between the feed rollers and the retraction rollers. The cutting assembly includes a stationary anvil and a rotating cutting blade defining a pivot. The cutting assembly further includes a drive assembly having a motor and a cam-follower mounted thereto.

A linkage member is operably mounted to the rotating cutter and has an elongated slot formed therein. The cam-follower is configured for receipt in and movement through the elongated slot. Actuation of the motor moves the cam-follower through the elongated slot to rotate the blade into engagement with the anvil. The blade engages the anvil when the cam-follower is at about a farthest-most position from the pivot.

In a preferred embodiment, the retraction rollers engage the strap following actuation of the cutting assembly. Most preferably, an ejection chute disposed between the feed rollers and the retraction rollers, and the faulted strap is ejected by the retraction rollers through the chute.

Other features and advantages of the present invention will be apparent from the following detailed description, in conjunction with the appended claims.

DETAILED DESCRIPTION OF THE PREFERRED EMBODIMENTS

Figure 2:
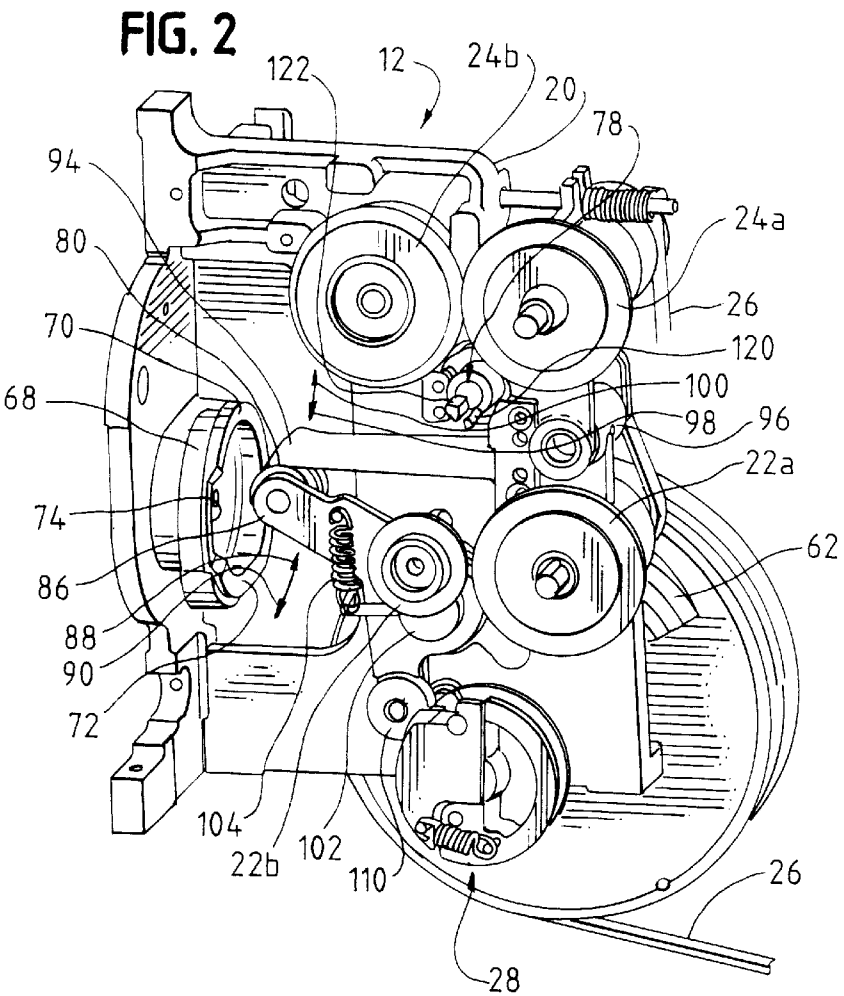
FIG. 2 is a front perspective view of the strapping head, the strapping head shown with portions of the frame removed for clarity of illustration, the head further shown without strap material positioned therein.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Figure 1:
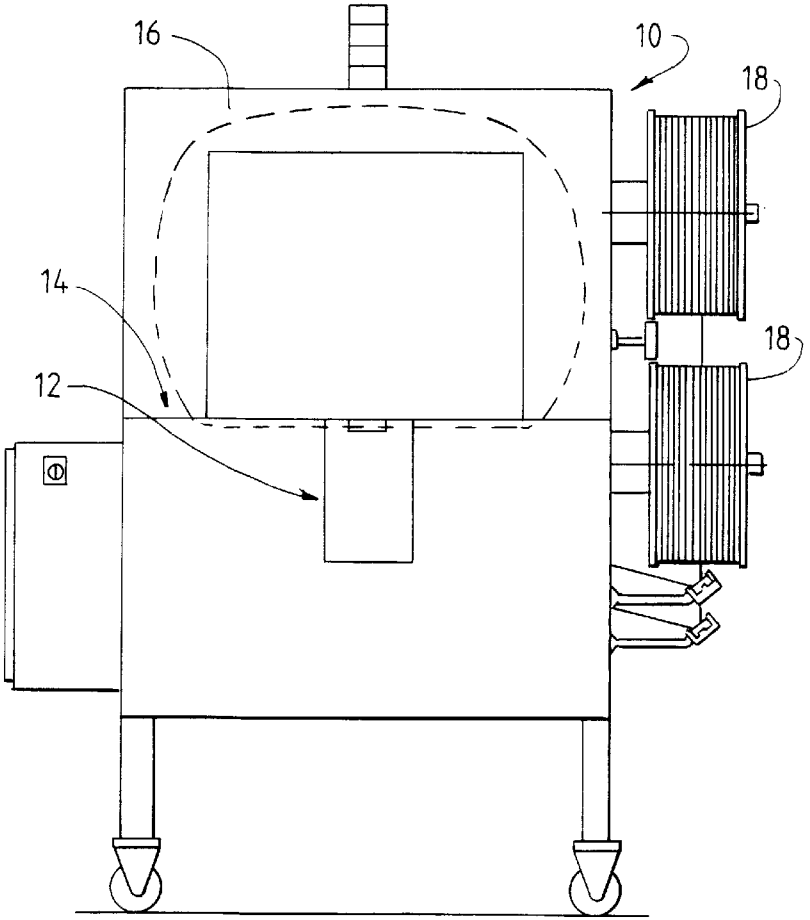
FIG. 1 is front view of a strapping machine illustrating, generally the components and arrangement thereof, the machine shown with a strapping head embodying the principles of the present invention.

Referring to the figures and in particular, to FIG. 1, there is shown a strapping machine 10 having a strapping head 12 embodying the principles of the present invention. The strapping machine 10 includes generally a workstation 14 such as the illustrated tabletop on which the load may be rested during the strapping operation. The machine 10 further includes a chute 16 around which the strap S is advanced during the strapping operation and one or more strap dispensers 18 from which the strap S is dispensed to the strapping head 12. The overall arrangement and operation of such a strapping machine 10 is disclosed in U.S. Pat. Nos. 4,605,456 and 5,299,407.

The strapping head 12 is that portion of the machine 10 that withdraws or pulls the strap S from the dispenser 18, feeds the strap S through the chute 16, grasps the leading edge of the strap so as to bring it into contact with a trailing portion, and tensions the trailing portion so as to compress the load.

Figure 4:
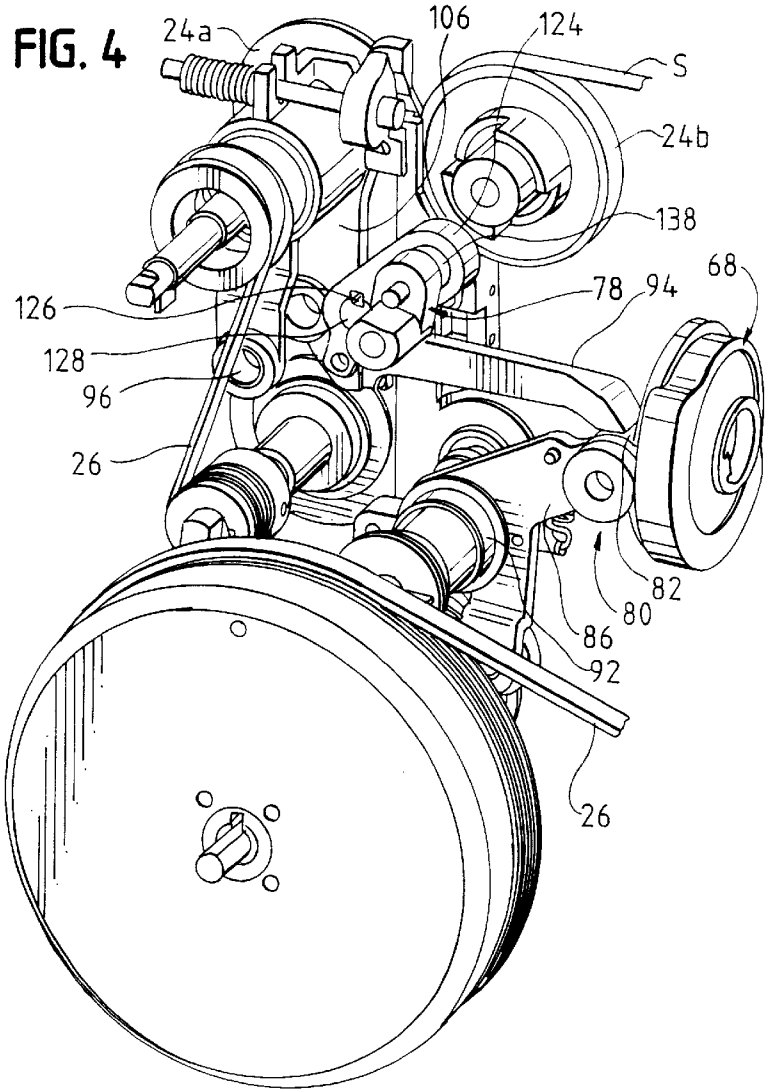
FIG. 4 is a rear perspective view of the strapping head of FIG. 3, again illustrated with portions of the frame removed for clarity of illustration.
Figure 3:
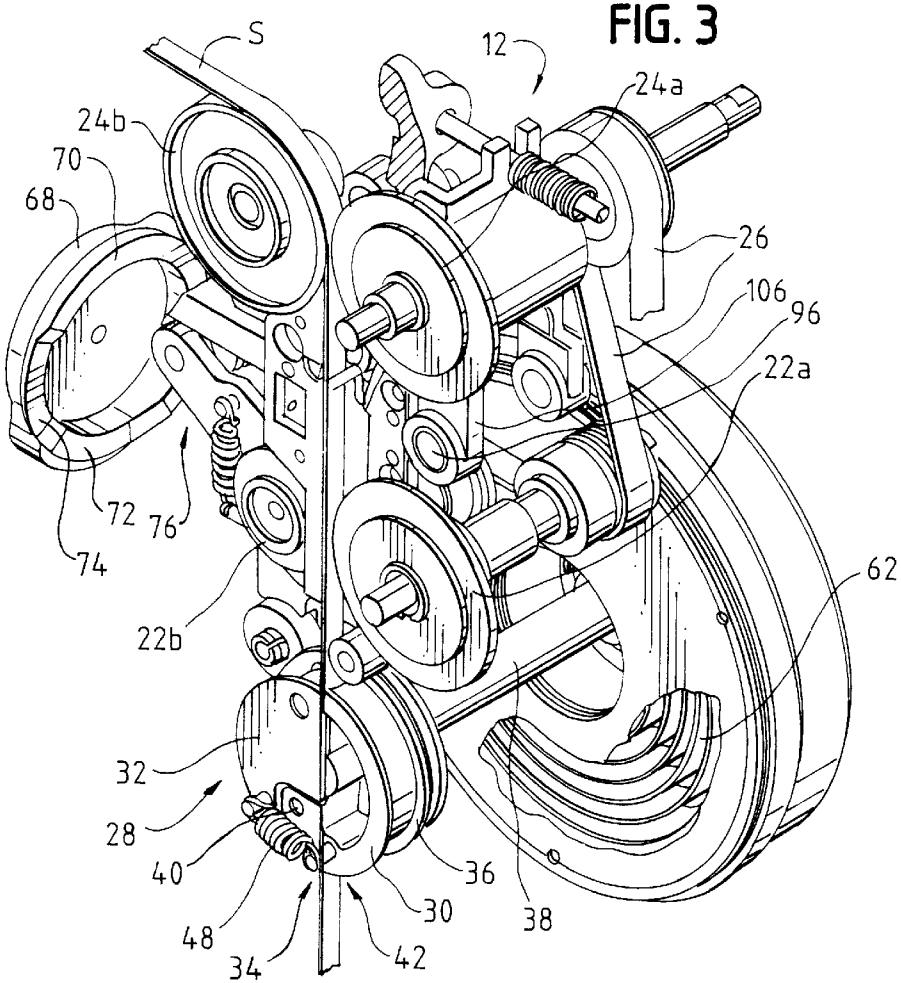
FIG. 3 is a front/side perspective view of the strapping head of FIG. 2 shown with other portions of the frame removed for clarity of illustration, this view shown with strap material traversing through the head in a normal travel path.

Referring now to FIGS. 2–4, the strapping head 12 includes a frame 20, a plurality of feed rollers 22*a,b* and a plurality of retraction rollers 24*a,b*. In the illustrated embodiment, two such feed rollers 22*a,b* and two such retraction rollers 24*a,b* are shown. In this embodiment, one of the feed rollers is a driven roller 22*a* while the other is an idler roller 22*b* that rotates only in frictional cooperation with its associated, driven roller 22*a*. Likewise, one of the retraction rollers is a driven roller 24*a* and the other is an idler roller 24*b* that rotates only in frictional cooperation with its associated driven roller 24*a*. The driven rollers 22*a*, 24*a* are driven by, for example, the exemplary belts drives 26. Those skilled in the art will recognize other arrangements by which the rollers 22*a*, 24*a* can be driven.

The strapping head 12 includes a biased, pivotal winder 28 that cooperates with the feed and retraction rollers 22, 24. As shown in FIGS. 2–3, the winder 28 is disposed in close proximity to the feed and retraction rollers 22, 24. Unlike known strapping machines, which position the winder between the feed and retraction rollers, in a preferred embodiment of the present machine 10, the winder 28 is positioned upstream of the feed and retraction rollers 22, 24. For purposes of the present discussion, upstream shall mean that side of the strapping head 12 from which the strap S material is fed (i.e., between the strapping head 12 and the dispensers 18) and downstream shall mean that side of the strapping head 12 to which the strap S is fed, (i.e., toward and around the chute 16).

As provided above, the winder 28 functions to produce tension in the strap S after the strap S is fully distributed around the load, and the "slack" in the strap S has been taken-up (i.e., after the strap S has been retracted). For example, after the strap S has been positioned around the load and in overlapping relation with itself, the retraction rollers 24*a,b* are actuated to retract the strap S to take-up any slack in the strap. The winder 28 is then actuated to further pull the strap S. In this manner, it exerts a tension in the strap S which compresses or bundles the load.

To this end, in the illustrated embodiment, the winder 28 is shown as having a generally circular profile, that is defined by a pair of generally semicircular elements 30, 32 forming a slot or channel, as indicated at 34, between the elements 30, 32. The slot 34 is sized to accommodate a range of strap gauges (thicknesses) and to permit the strap to move freely through the slot 34 during the feeding and retraction operations of the strapping machine 10.

Figure 5:
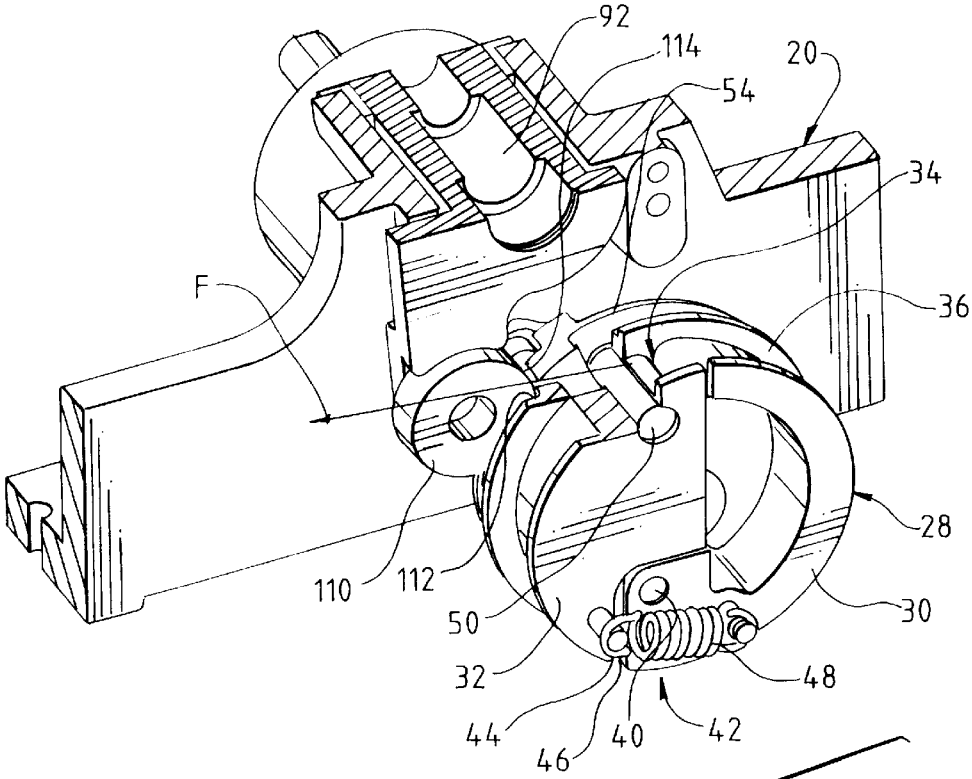
FIG. 5 is a front perspective view of the winder and intermediate stop plate, the winder being shown in partial cross-section.
Figure 6:
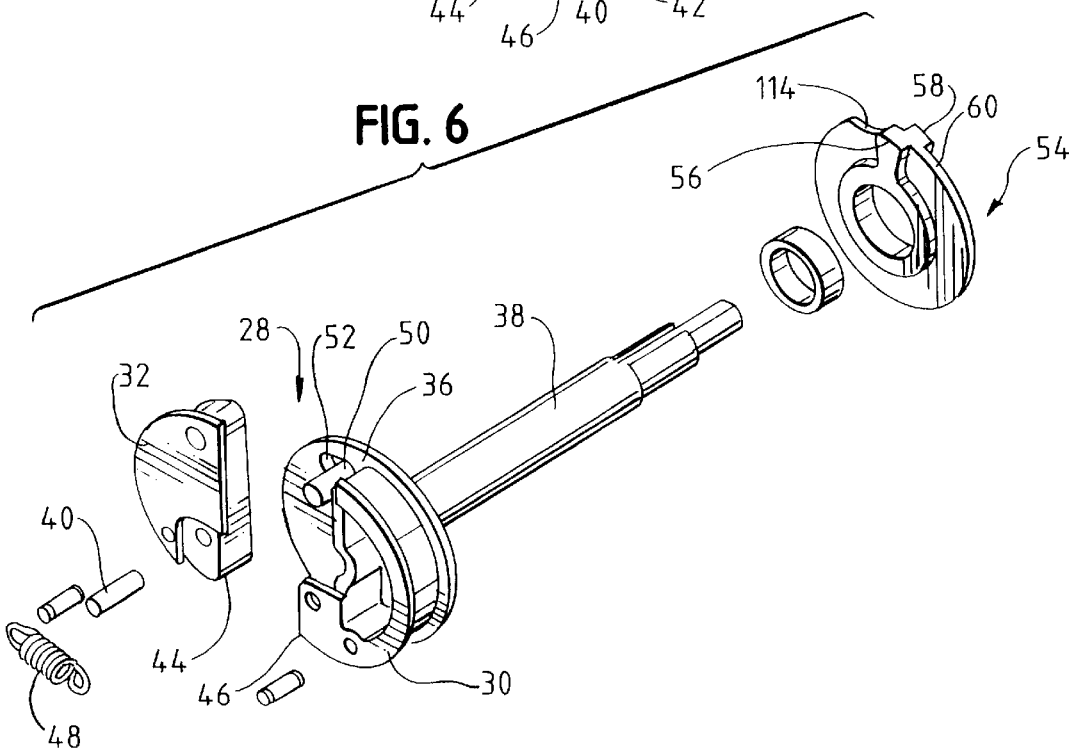
FIG. 6 is an exploded view of the winder also shown with an intermediate stop plate.

Unlike known rewinding devices, which include stationary halves mounted on a rotating shaft, the present winder 28 includes a stationary element 30 and a pivotal or hinged element 32. Referring now to FIGS. 5–6, the stationary element 30 is mounted to (or formed as part of) a back plate 36 which in turn is mounted to or formed as part of a shaft 38 about which the winder 28 rotates. The pivotal or hinged element 32 pivots relative to the stationary element 30 about a pivot pin 40 positioned at the upstream side, as indicated at 42, of the winder 28. The stationary and pivotal elements 30, 32 define a variable gap therebetween. At the upstream-most side 42 of the winder 28, the stationary and pivotal members 30, 32 define gripping portions 44, 46 that grip or pinch the strap S therebetween during the winding operation.

The pivotal element 32 is biased by, for example, a coil spring 48, into a position so that the stationary and pivotal element gripping portions 44, 46 contact one another, i.e., are biased into a closed position. The pivotal element 32 includes an upper stop pin 50 that extends fully through a notched opening 52 in the back plate 36. The upper stop pin 50 is configured to contact an intermediate stop plate 54, discussed below, to maintain the pivotal element 32 in the open position during strap S feed and retraction operations. The notched opening 52 in the back plate 36 permits the pivotal element 32 to be maintained in the open position when the winder 28 is at the home position.

To permit the winder 28 to rotate more than 360 degrees without interference by the upper stop pin 50 preventing such rotation, the intermediate stop plate 54 is mounted between the winder 28 and the frame 20. The intermediate stop plate 54 rotates about the winder shaft 38 and includes a winder stop 56 and a frame stop 58. These stops 56, 58 extend in opposing directions, longitudinally from about a periphery 60 of the stop plate 54. An exemplary plate 54 is illustrated in FIG. 6. The winder stop 56 is that stop against which the upper stop pin 50 bears to maintain the winder 28 open in the home position.

The winder 28 further includes a winder spring 62, such as the exemplary clock-type spring that is mounted to the shaft 38 to return the winder 28 to the home position after the winding operation.

Again, also unlike known strapping heads, the present strapping head 12 utilizes a single cam 68 having a plurality of camming surfaces 70, 72, 74 for actuating a linkage arrangement 76 that engages and disengages the feed and retraction rollers 22, 24. The linkage arrangement 76 is better seen in the rear view of the strapping head 12 in FIG. 4. As will be recognized by those skilled in the art, the feed and retraction rollers 22, 24 are driven in opposite directions from one another, and either the feed 22 or retraction 24 rollers are engaged with the strap S at any given time. That is, if the feed rollers 22 are engaged with the strap S to feed the strap S, the retraction rollers 24 are disengaged from the strap S. Conversely, when the retraction rollers 24 are engaged with the strap S to take up slack or retract the strap S, the feed rollers 22 are disengaged from the strap S.

Additionally, when the winder 28 is used to tension the strap S, both the feed and retraction rollers 22, 24 are disengaged from the strap S. As such, any one of the three strap engaging portions of the strapping head 12 (the feed rollers 22, the retraction rollers 24 and the winder 28) operate on the strap S at any one time.

The present linkage 76 operably connects these operated system portions using a single cam 68 and a single cain-contacting bearing 80 to effectuate proper sequencing and operation of the strapping head 12. Referring to FIG. 4, the linkage 76 includes a first or feed roller linkage arm 86 that is moved between an engaged position and a disengaged position (as indicated by the arrows at 88 and 90, respectively), to engage and disengage the feed rollers 22, respectively. The feed roller linkage arm 86 pivots about a first pivot 92. A second or retraction roller linkage arm 94 pivots about a second pivot 96 between an engaged position and a disengaged position (as indicated by the arrows at 98 and 100, respectively) to engage and disengage the retraction rollers 24. The cam-contacting bearing 80 is positioned on the feed roller linkage arm 86.

The cam 68 includes three operating surfaces. A first (highest or feed) surface 70 urges the feed roller linkage 86 into the engaged position 88. An eccentric secondary linkage 102 (FIG. 2) is mounted on and operably connected to the feed roller linkage 86. The idler feed roller **22*b* is mounted to the eccentric secondary linkage 102 and is brought into contact with the strap S to suppress the strap S against the driven feed roller 22*a*. The eccentric secondary linkage 102 is biasedly connected to the feed roller linkage 86, by, for example, a coil spring 104, to assure that sufficient pressure is maintained on the strap S by the driven feed roller 22*a* so that the strap S is properly fed through the strapping head 12 and chute 16. When the cam-contacting bearing 80 bears on the second or third operating surfaces (home or intermediate 72, and retraction or lowest surfaces 74, respectively), the feed roller linkage 86 moves to the disengaged position 90 to disengage the feed rollers 22*a,b*** from one another and from the strap S.

The retraction roller linkage arm 94 rests on a second portion 82 of the camcontacting bearing 80 and is biased so that it maintains contact with this portion 82 of the bearing 80. The retraction roller linkage arm 94 is connected to a carriage 106 that pivots about the frame 20 at the second pivot 96 and biases the linkage 94 against the bearing portion 82 and biases the retraction rollers **24*a,b* into the engaged position. Unlike the feed roller 22 arrangement, the driven retraction roller 24*a* is moved into and out of contact with the idler roller 24*b***.

When the cam-contacting bearing 80 bears on the feed or home surfaces 70, 72 (highest and intermediate surfaces, respectively), the retraction roller linkage 94 moves to the disengaged position 100 to disengage the driven retraction roller **24*a* from the idler roller 24*b* and the strap S. As will be understood from a study of the figures, the retraction linkage 94 in these two positions is urged upwardly, as indicated by the arrow at 100, which pivots the retraction carriage 106 to move the driven retraction roller 24*a* away from the idler roller 24*b*. Conversely, when the cam-contacting bearing 80 bears on the lowest or retraction surface 74, the retraction linkage 94 moves downwardly, as indicated by the arrow at 98, which, in turn, moves the driven retraction roller 24*a* into contact with the strap S to suppress the strap S between the retraction rollers 24*a,b*** to retract or take-up the strap S.

During the rewinding or tensioning portion of the strapping cycle, the cam-contacting bearing 80 again bears on the cam retraction surface 74 which moves feed roller **24*b* into the disengaged position 90. During this portion of the cycle, the retraction rollers 24*a,b* must also be disengaged from one another and from the strap S. To this end, with reference to FIGS. 3 and 5–6, a second bearing 110 rides along an outer periphery of the winder 28 and the intermediate stop plate 54. As the winder 28 begins to rotate, the second bearing 110 is urged out of a small depression 112, 114 in each of the winder 28 and intermediate plate 54 peripheries. The depressions 112, 114 are aligned with the second bearing 110 when the winder 28 and the intermediate stop plate 54 are in the winder home position. The second bearing 110, which is mounted to the feed roller linkage 86, urges the feed roller linkage 86 upward which in turn moves the retraction roller linkage arm 94 upward. The upward movement of the retraction roller linkage arm 94 moves the retraction rollers 24***a,b* into the disengaged position. The winder 28 then continues to rotate clockwise as seen in FIG. 5.

Figure 7A:
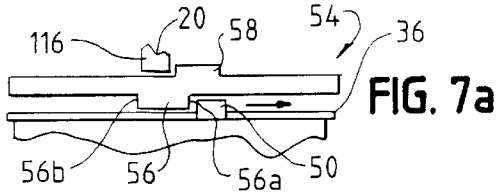
FIGS. 7*a–d* are schematic views of the relative rotation of the winder and stop plate shown through about 720 degrees of revolution.
Figure 7B:
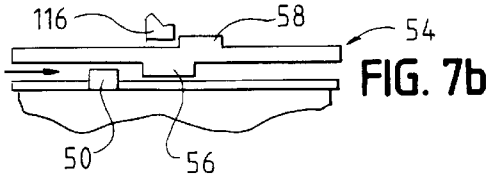

Referring now to FIGS. 5 and 7*a–d,* as the winder 28 moves off of the home position as seen in FIG. 7*a,* the upper stop pin 50 moves out of contact with the intermediate plate winder stop 56. This permits the spring 48 to move the winder pivotal element 32 into the closed or gripping position. The friction developed between the gripping portions 44, 46 of the winder 28 and the strap S causes the winder 28 to immediately commence tensioning the strap S, without the strap S having to wind onto itself to develop the necessary friction. The pivotal configuration of the winder 28 further enhances the gripping of the strap S. As the winder 28 begins to rotate clockwise as seen in FIG. 5, the strap S exerts a force F on the pivotal element 32 that is tangential to the winder 28 and in a direction opposite to the rotation of the winder 28. This force F translates to a increased pressure applied to the strap S at the gripping portions 44, 46.

Figure 7C:
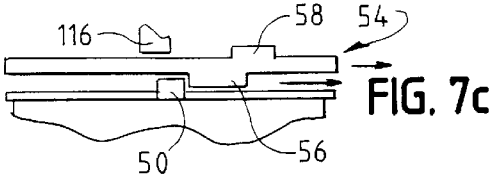
Figure 7D:
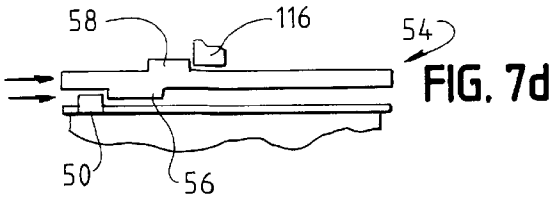

Referring again to FIGS. 7*a–d,* the winder 28 and intermediate stop plate 54 are configured so that the winder 28 can rotate, in the winding mode, greater than 360 degrees. As seen in FIG. 7*a,* as the winder 28 begins to rotate, the upper stop pin 50 moves off of a first side 56*a* of the winder stop 56 on the plate 54. As the winder 28 continues to rotate, approaching a 360 revolution (FIG. 7*b*), the stop pin 50 contacts a second side 56*b* of the winder stop 56 which permits further rotation of the winder 28 and rotates the plate 54 (FIG. 7*c*). Continuing beyond the first 360 degree revolution, as the winder 28 and stop plate 54 approach 720 degrees of revolution (FIG. 7*d*), the frame stop 58 contacts a stub or like projection 116 extending from the frame 20 which stops the winder 28 and plate 54. This provides a limit to rotation, which is advantageous from a machine 10 control standpoint.

As will be recognized by those skilled in the art, additional intermediate stop plates 54 can be positioned between the winder 28 and the frame 20 to permit rotation of the winder 28 beyond about 720 degrees. Each additional intermediate stop plate 54 provides an additional about 360 degrees of rotation. For example, a winder 28 having two intermediate plates 54 can rotate about 1080 degrees (360 degree rotation for the winder 28 plus 360 degree rotation for each of the two intermediate stop plates 54). Those skilled in the art will recognize that the degree of rotation is slightly less than 360 degrees because of that portion of the arc that is needed to accommodate the winder and frame stops 56, 58, respectively.

In the next operational step, the strap S is grasped at about the location at which the leading and trailing portions overlap. The leading and trailing portions of the strap are welded or otherwise joined to one another around the load to maintain the load under compression. After the strap is fixed, e.g., welded around the load, the free end of the strap is cut and the load is removed from the strapping machine 10. This step of the operation is more fully disclosed in the aforementioned U.S. Pat. No. 4,605,546. Subsequently, the winder spring 62 returns the winder 28 to the home position, and the strapping machine 10 is readied for strapping a next load.

The strapping head 12 is configured so that in the event of a fault, the strapping head 12 will sense the fault, automatically cut the strap S upon receipt of a fault signal and eject the strap from the machine 10. The head 12 will then automatically refeed the strap S to ready the machine 10 for a next load. Such an arrangement for automatic fault-strap ejection is fully disclosed in Bell, U.S. Pat. No. 5,640,899, which patent is assigned to the assignee of the present application and is incorporated by reference herein.

Figure 8:
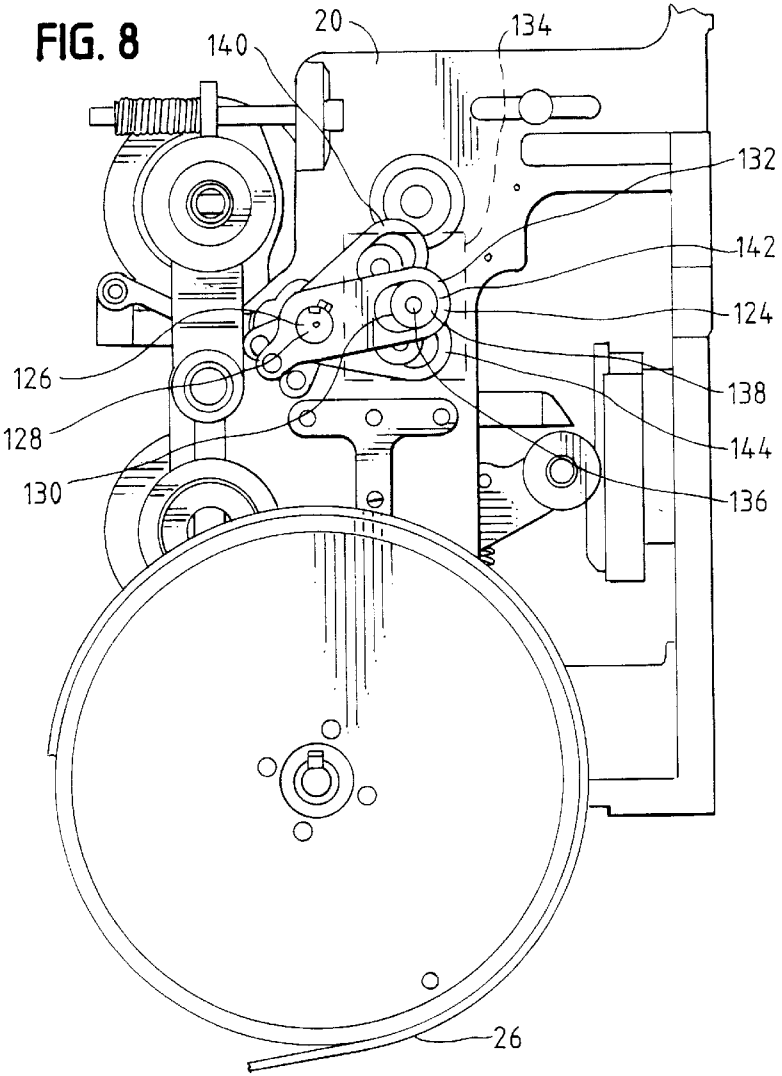
FIG. 8 is rear schematic view of the strapping head illustrating the positions of the cutter linkage as it moves through one cutting and eject cycle.

A cutter 78 includes a stationary cutting portion or anvil 120 and a rotating cutting portion or blade 122. During normal strapping operations, the anvil 120 and blade 122 are spaced from one another and the strap S passes between them. Upon receipt of a fault signal, the feed rollers 22*a,b* are disengaged from the strap S, and the cutter 78 is actuated. Referring to FIGS. 2, 4 and 8, the cutter 78 is mounted to the frame 20 by an eccentric linkage arrangement 124. A pivot 126 of the linkage 124 rotates a stub shaft 128 to which the cutting blade 122 is attached. The linkage 124 includes an elongated slot 130 at about a distal end 132 of the linkage 124 spaced from the pivot 126. The cutter drive includes a gear-type motor 134 that rotates a shaft 136 having a cam-follower 138 mounted to an end thereof. The cam-follower 138 is positioned within the linkage slot 130. When the cutter 78 is in the "rest" state (as indicated at 140), the cam-follower 138 is positioned within the slot 130 near to the pivot 126.

When the cutter 78 is actuated, the motor 134 drives the cam-follower 138 in an arc. As the cam-follower 138 moves through this arcuate path, it traverses through the slot 130 from the rest position 140, at which it is near to the pivot 126, to a position farthest from the pivot 126 (or a "cut" position as indicated at 142), while at the same time rotating the linkage 124. The rotational movement of the linkage 124 brings the cutting blade 122 into contact with the anvil 120, which in turn severs the strap S positioned between the blade 122 and the anvil 120. Following the cutting portion of the cycle, the cam-follower 138 continues through its cycle to an eject position (as indicated at 144) and the retraction rollers 24*a,b* are actuated and engage the faulted strap to eject the strap through an eject chute provided in the head 12.

Following the cutting operation, as will be understood by those skilled in the art, although the faulted strap S has been ejected from the head 12, it is only that portion of the strap downstream from the cutter 78 that has been ejected. The strap up to the cutter 78, including the strap that is present in the winder 28 and between the feed rollers 22*a,b* remains in place and intact during the ejection cycle. Thus, after the ejection cycle, the feed rollers 22*a,b* actuate to automatically refeed the strap S through the head 12 to ready the machine 10 for a next load.

As can be seen in FIGS. 2 and 8, the cutter linkage 124 is configured so that the actual cutting or severing operation (that point at which the blade 122 meets the anvil 120 with the strap S between them) is carried out taking maximum mechanical advantage of the linkage arrangement 124. At the point at which the blade 122 and anvil 120 meet, the cam-follower 138 is at the farthest-most point of the elongated slot 130. Thus, because the blade 122 is at about the pivot 126 of the linkage 124, the cutting force is applied at a maximum or near maximum distance (i.e., with a greatest moment) between the blade 122 and the force.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping machine for positioning a strap material around an associated load and tensioning the strap material around the load, comprising:

a frame for supporting the load;

a chute positioned on the frame for receiving the strap material and orienting the strap material around the load;

a strap supply; and a strapping head for extracting the strap from the supply, feeding the strap through the chute around the load, passing the strap from the chute around the load, retracting and tensioning the strap, the strapping head including feed rollers and retraction rollers for feeding and retracting the strap and a winder for tensioning the strap around the load, the winder including a rotating head portion having a stationary element and an element movable toward and away from the stationary element, the stationary and movable elements each defining an outer surface around which the strap material is wound and defining a slot therebetween for receiving the strap material, the movable element being movable between an open position in which the strap freely moves through the slot and a closed position in which the stationary and movable elements cooperate with one another to engage and secure the strap material therebetween, wherein the winder rotates from a home position in which the winder is in the open position and an other than home position in which the winder is in the closed position to engage and secure the strap in the slot.

2. The strapping machine in accordance with claim 1, wherein the winder is positioned between the feed and retraction rollers and the strap supply.

3. The strapping machine in accordance with claim 1 including a biasing element for biasing the movable element into the closed position.

4. The strapping machine in accordance with claim 1, wherein the movable element is pivotally mounted to the head portion for movement toward and away from the stationary element.

5. A strapping machine for positioning a strap material around an associated load and tensioning the strap material around the load, comprising:

a frame for supporting the load;

a chute positioned on the frame for receiving the strap material and orienting the strap material around the load;

a strap supply; and a strapping head for extracting the strap from the supply, feeding the strap through the chute around the load, passing the strap from the chute around the load, retracting and tensioning the strap, the strapping head including feed rollers and retraction rollers for feeding and retracting the strap and a winder for tensioning the strap around the load, the winder being positioned between the feed and retraction rollers and the strap supply, the winder including a rotating head portion having a stationary element and a pivotal element, the stationary and pivotal elements each defining an outer surface around which the strap material is wound and defining a slot therebetween for receiving the strap material, the stationary and pivotal elements each defining a gripping portion at about respective ends opposingly facing one another, the pivotal element being pivotal between an open position in which the gripping portions are spaced from one another and a closed position in which the gripping portions cooperate with one another to engage and secure the strap material therebetween, wherein the winder rotates from a home position in which the winder is in the open position and an other than home position in which the winder is in the closed position to exert a tension in the strap.

6. The strapping machine in accordance with claim 5 including a biasing element for biasing the pivotal element into the closed position.

7. The strapping machine in accordance with claim 6 including a projection extending from the pivotal element for maintaining the pivotal element in the open position when the winder is in the home position.

8. The strapping machine in accordance with claim 5 wherein the winder includes a drive assembly for rotating the winder head portion.

9. The strapping machine in accordance with claim 8 wherein the winder includes a winder biasing element for returning the winder to the home position.

10. The strapping machine in accordance with claim 9 including an intermediate stop plate positioned between the winder head portion and the frame, the intermediate stop plate configured to permit greater than 360 degree rotation of the winder relative to the strapping machine.

11. The strapping machine in accordance with claim 9 wherein the winder pivotal element includes a projection extending therefrom for maintaining the pivotal element in the open position when the winder is in the home position, and including an intermediate stop plate having a winder stop and a frame stop extending therefrom at about a periphery of the intermediate stop plate, the winder stop configured to engage the pivotal element projection to maintain the winder in the home position and to maintain the pivotal element in the open position, and wherein the intermediate stop plate rotates with the winder to maintain the winder in the home position, and wherein the intermediate stop plate is configured to permit greater than 360 degree rotation of the winder.

* * * * *

UNITED STATES PATENT AND TRADEMARK OFFICE

CERTIFICATE OF CORRECTION

PATENT NO. : 6,463,848 C1
APPLICATION NO. : 90/012461
DATED : March 26, 2013
INVENTOR(S) : Haberstroh et al.

It is certified that error appears in the above-identified patent and that said Letters Patent is hereby corrected as shown below:

In the Claims:

Column 1

In Claim 1, Line 30: The word "refracting" should be "retracting." The line should read, "...from the chute around the load, retracting and then tensioning the strap..."

In Claim 1, Line 32: The word "refraction" should be "retraction." The line should read, "...feed rollers and retraction rollers for feeding and retracting the strap..."

Column 2

In Claim 3, Line 33: There should not be a "-" after the word "winder."

Signed and Sealed this
Twenty-fourth Day of September, 2013

Teresa Stanek Rea
*Deputy Director of the United States Patent and Trademark Office*

US006463848C1

(12) EX PARTE REEXAMINATION CERTIFICATE (9573rd)

United States Patent

Haberstroh et al.

(10) Number: US 6,463,848 C1

(45) Certificate Issued: Mar. 26, 2013

(54) STRAPPER WITH IMPROVED WINDING AND CUTTING ASSEMBLY

(75) Inventors: James A. Haberstroh, Vernon Hills, IL (US); Robert J. Kobiella, Rolling Meadows, IL (US); Timothy B. Pearson, Antioch, IL (US); Mark B. Renz, Arlington Heights, IL (US)

(73) Assignee: Illinois Tool Works Inc., Glenview, IL (US)

Reexamination Request:
No. 90/012,461, Sep. 4, 2012

Reexamination Certificate for:

| | |
|---|---|
| Patent No.: | **6,463,848** |
| Issued: | **Oct. 15, 2002** |
| Appl. No.: | **09/566,512** |
| Filed: | **May 8, 2000** |

(51) Int. Cl.
*B65B 13/22* (2006.01)

(52) U.S. Cl.
USPC ..... 100/32; 100/26; 53/589

(58) Field of Classification Search ..... None
See application file for complete search history.

(56) References Cited

To view the complete listing of prior art documents cited during the proceeding for Reexamination Control Number 90/012,461, please refer to the USPTO's public Patent Application Information Retrieval (PAIR) system under the Display References tab.

*Primary Examiner* — Danton DeMille

(57) ABSTRACT

A strapping machine for positioning a strap material around an associated load and tensioning the strap material around the load includes a frame for supporting the load, a chute positioned on the frame for receiving the strap material and orienting the strap material around the load, a strap supply and a strapping head for extracting the strap from the supply, feeding the strap through the chute around the load, passing the strap from the chute around the load, retracting and tensioning the strap. The strapping head includes feed rollers and retraction rollers for feeding and retracting the strap and a winder for tensioning the strap around the load. The winder is positioned between the feed and retraction rollers and the strap supply. The winder includes a rotating head portion having a stationary element and a pivotal element. The stationary and pivotal elements each define an outer surface around which the strap material is wound and a slot therebetween for receiving the strap material. The stationary and pivotal elements each further define a gripping portion at about respective ends opposingly facing one another. The pivotal element is pivotal between an open position in which the gripping portions are spaced from one another and a closed position in which the gripping portions cooperate with one another to engage and secure the strap material therebetween. The winder rotates from a home position in which the winder is in the open position and an other than home position in which the winder is in the closed position to exert a tension in the strap.

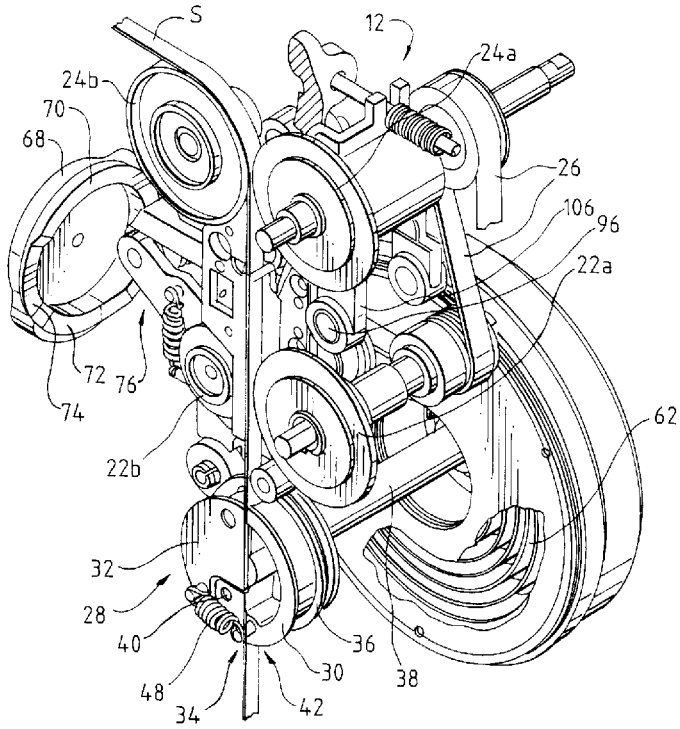

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1, 3 and 4 are determined to be patentable as amended.

Claims 5-11 were not reexamined.

1. A strapping machine for positioning a strap material around an associated load and tensioning the strap material around the load, comprising:

a frame for supporting the load;

a chute positioned on the frame for receiving the strap material and orienting the strap material around the load;

a strap supply; and a strapping head for extracting the strap from the supply, feeding the strap through the chute around the load, passing the strap from the chute around the load, refracting and tensioning the strap, the strapping head including feed rollers and refraction rollers for feeding and retracting the strap and a winder for tensioning the strap around the load, the winder including a rotating head portion having a stationary element and an element movable toward and away from the stationary element, the stationary and movable elements each defining an outer surface around which the strap material is wound and defining a slot therebetween for receiving the strap material, the movable element being movable between an open position in which the strap freely moves through the slot and a closed position in which the stationary and movable elements cooperate with one another to engage and secure the strap material therebetween, wherein the winder rotates from a home position in which the winder is in the open position and an other than home position in which the winder is in the closed position to engage and secure the strap in the slot, *and wherein the winder is positioned between the feed and retraction rollers and the strap supply*.

3. [The] *A* strapping machine [in accordance with claim 1] *for positioning a strap material around an associated load and tensioning the strap material around the load, comprising:*

*a frame for supporting the load;*

*a chute positioned on the frame for receiving the strap material and orienting the strap material around the load;*

*a strap supply; and*

*a strapping head for extracting the strap from the supply, feeding the strap through the chute around the load, passing the strap from the chute around the load, retracting and tensioning the strap, the strapping head including feed rollers and retraction rollers for feeding and retracting the strap and a winder for tensioning the strap around the load, the winder including a rotating head portion having a stationary element and an element movable toward and away from the stationary element, the stationary and movable elements each defining an outer surface around which the strap material is wound and defining a slot therebetween for receiving the strap material, the movable element being movable between an open position in which the strap freely moves through the slot and a closed position in which the stationary and movable elements cooperate with one another to engage and secure the strap material therebetween, the winder-*including a biasing element for biasing the movable element into the closed position, *wherein the winder rotates from a home position in which the winder is in the open position and an other than home position in which the winder is in the closed position to engage and secure the strap in the slot*.

4. The strapping machine in accordance with claim [1] *3*, wherein the movable element is pivotally mounted to the head portion for movement toward and away from the stationary element.

* * * * *